US005209302A

United States Patent [19]

Robichaux et al.

[11] Patent Number: 5,209,302

[45] Date of Patent: May 11, 1993

[54] SEMI-ACTIVE HEAVE COMPENSATION SYSTEM FOR MARINE VESSELS

[75] Inventors: Leland R. Robichaux; Jan T. Hatleskog, both of Aberdeen, Scotland

[73] Assignee: RETSCO, Inc., Houston, Tex.

[21] Appl. No.: 769,054

[22] Filed: Oct. 4, 1991

[51] Int. Cl.[5] ..... E21B 19/09

[52] U.S. Cl. ..... 166/355; 175/5

[58] Field of Search ..... 166/355; 175/24

[56] References Cited

U.S. PATENT DOCUMENTS 3,311,351 2/1966 Blakely .
3,314,657 4/1967 Prud'Homme et al. .
3,403,728 10/1968 Richardson et al. .
3,718,316 2/1973 Larralde et al. .
3,791,628 2/1974 Burns et al. .
3,804,183 4/1974 Duncan et al. .
3,841,607 10/1974 Larralde et al. .
3,912,227 10/1975 Meeker et al. .
3,946,559 3/1976 Stevenson .
4,540,159 9/1985 Jordan .
4,638,978 1/1987 Jordan .
4,962,817 10/1990 Jones et al. ..... 166/355 X
5,067,488 12/1991 Freyer et al. ..... 166/355 X

FOREIGN PATENT DOCUMENTS 1137180 1/1985 U.S.S.R. ..... 166/355

*Primary Examiner*—William P. Neuder
*Attorney, Agent, or Firm*—John R. Kirk, Jr.

[57] ABSTRACT

A semiactive heave compensation system for marine vessels, especially floating offshore drilling rigs, is described. The system can be installed in its entirety or can be used to modify existing passive systems by including heave and compensating sensors a microprocessor and a responsive operator to act upon the compensation elements of the system.

7 Claims, 6 Drawing Sheets

SEMI-ACTIVE HEAVE COMPENSATION SYSTEM FOR MARINE VESSELS

FIELD OF THE INVENTION

This invention relates to a system to improve heave compensating apparatus for the effect of motion of waves on marine vessels. It is particularly useful in improving the operational results of hydraulic/-pneumatic drill string compensators on floating drilling rigs.

BACKGROUND OF THE INVENTION

The search for, and production of, oil through the ocean floor is often accomplished using a floating marine vessel subject to considerable vertical motion due to the heaving of the waves. During storm conditions when the sea is abnormally high, operations, particularly drilling operations, must be curtailed, running the risk of the drill pipe sticking in the hole or the risk of pulling the string from the well in inclement weather to remove the bit from the bottom. Often, damage results in the bore hole at great expense. Other precise operations occur during operations, such as, for example, setting a blowout preventer around the wellhead on the ocean floor, logging the wellbore, perforating casing into a producing zone, setting a packer and the like.

During any such operation from the platform of a vessel moored at sea, compensation must be made for the changes in level due to wave action. Hydropneumatic cable tensioners are used in the mooring. Examples of such devices are described in U.S. Pat. Nos. 3,314,657; 4,540,159; and 4,638,978. In addition, motion compensators are found to be useful with almost any load carrying device used at sea, such as, for example, a crane as described in U.S. Pat. Nos. 3,311,351 or 3,718,316. However, by far the most pressing use has been to compensate the motion around the drill string itself, either at the crown block (U.S. Pat. No. 3,791,628), an in line compensator between the hook and the traveling block (U.S. Pat. Nos. 3,403,728 or 3,841,607) and on the traveling block itself (U.S. Pat. Nos. 3,912,227 and 3,718,316; 3,804,183, for example). The disclosures of the foregoing patents and principles discussed therein are all well known and incorporated herein by reference for all purposes to set forth the state of the art against which this invention is made. The most common drill string compensators are carried on the traveling block. In one system, typically the disclosure of U.S. Pat. No. 3,804,183, the piston rod is under compression forces from the hook upon which the drill string is hung. In another system it is under tension as can be seen in U.S. Pat. No. 3,718,316.

It is common among all such motion compensators to employ a moving piston and rod system separating two dissimilar fluids as shock absorbers, acting easily as a spring, usually compressed air and a hydraulic fluid employing compressed air reservoirs and an accumulator vessel, to transmit the fluids to compensate for pressure changes brought about by the heaving of the sea surface. Just as the elements of the various assemblies are common and well known, also known is the degree of accuracy with which a load on the hook can be held in one place and the large response time between a change in the level of the sea and the application of pressure from the accumulator into the cylinder and piston system of the motion compensating apparatus to return the system to its working conditions.

In most cases, the accumulator sits on the drill floor with fluid lines running some distance to the motion compensating system, either at the crown block or at the traveling block. Indeed, in some instances, such as the hydropneumatic cable tensioners described in U.S. Pat. Nos. 4,540,159 and 4,638,978, the accumulator is in an annulus of the body of the compensating system. Even then response time losses occur and load variations are left unresolved. The load variations and time lapse for response arise from a number of factors; such as the large volume of air in the commonly used air bank, piston friction losses within the cylinders and pressure drop in the fluid (oil) and air conduits. In drilling systems, in order to compensate for wide weight variations, very strong drill pipe is used necessitating larger drill bits, larger casing and more difficult, and expensive, drilling operations. Heavier, drill strings were required to avoid breakage due to the heaving jerks on the string or inaccurate bit control due to heavy weight on the bit causing a bend in the drill string. In attempts to use lighter drill strings and smaller bits is so-called slimhole drilling, the need for closer control of weight variation on the bit is more critical.

Attempts have been made to devise active heave compensating devices for marine use which would aid the accumulator in compensating for pressure changes in the heave compensation system. One such system is described in U.S. Pat. No. 3,946,559. The device, while an improvement, still leaves much to be desired and the overall problem has remained unsolved until now.

It is therefore an object of this invention to provide a system which will compensate for the heave of waves on a marine vessel with reduced response time and variations in weight control on a drill bit in a drilling system.

It is a further object of this invention to provide a system for compensating for the heave of waves on marine vessels which will reduce the effects of bad weather on drilling operations, reducing the necessity to remove the bit from the borehole being drilled in the subsurface floor.

It is a further object of this invention to provide an improved motion compensation, or weight control, system which can be added to an existing passively operated piston and cylinder compensating system on drill string compensators, cable tensioners, cranes and the like on marine vessels.

It is a further object of this invention to provide a drill string compensation system to improve weight control in compensating apparatus which operates either under tension or under compression when the hook is loaded.

It is a further object of this invention to provide a system for improved weight control by passive heave compensating systems used as drill string compensators, cable tensioners and a load carrying hook on a crane.

SUMMARY OF THE INVENTION

The present invention provides a system for the compensation of heave of waves on a marine vessel, preferably using an existing passive heave compensation means which employs a fluid responsive compensator which includes a load carrying means such as a hook or a sheave, a chamber for receiving and discharging fluid and a piston moving within said chamber, or another chamber in communication with it in response to changes in fluid pressure to reposition the load carrying means. The improved system includes an accumulator, as do the passive systems, modified to include an actuator cylinder, having an actuator piston and dividing the cylinder into a first and second internal chamber with the piston rod of the actuator cylinder and the piston rod of the accumulator piston are attached such that the accumulator piston moves in response to movement of the actuator piston rod. The actuator piston and, consequently, its rod, move from a desired or set position in response to the changes of fluid pressure in chambers of the actuator cylinders. This fluid pressure change is brought about by a variable pump, normally a swash plate pump, having the characteristics of a variable chamber, allowing the pump to idle without moving fluid or pump fluid in either direction, thus through the connections with the top and bottom of the actuator cylinder chambers can selectively increase or decrease pressures in the fluid chamber in the accumulator, which communicates with the compensator, thus moving fluid quickly in either direction in response to changes in conditions to heave from the ocean.

The variable pump receives its commands from a controller. In this invention a sensor determines the changes of conditions within the compensator system, such as changes in pressure or the position of the compensator piston, which information is communicated to the controller, which compares values sensed in sequence to determine a rate and direction of change. The system of this invention includes a means for sensing the heave in a vessel through connection to a guideline, or tension line, connected to the floor of the sea, which information is also conveyed to the controller. The controller compares such signals and the rates of change and compares the output setting of the pump adjusting such output to return the desired conditions in the compensator to a previous set point. This is accomplished by pumping fluid into the actuator cylinder such that the accumulator piston is moved to change fluid volume in the compensator to offset conditions caused by the heave in the waves. Some other minor modifications of the passive system may be made in certain circumstances to enhance the operation of the system of this invention.

DETAILED DESCRIPTION OF THE INVENTION

The environment within which the search for oil is conducted beneath the surface of the seas of the world is ever changing and often treacherous. It changes constantly due to the ebb and flow of the surface of the water and treachery occurs during inclement weather. Drilling is accomplished in shallow waters by use of a jack-up rig securely anchored to the ocean floor, while in deeper water, floating drill vessels are used, which are moored over the site of the well with large amounts of drilling tubular goods being suspended from the anchored drilling barge, which is in constant motion, often more than a thousand feet from the ocean floor where drilling is occurring. Yet, in spite of the difficult circumstances, it is nevertheless necessary to control conditions, particularly the weight on the drill bit.

Figure 1:
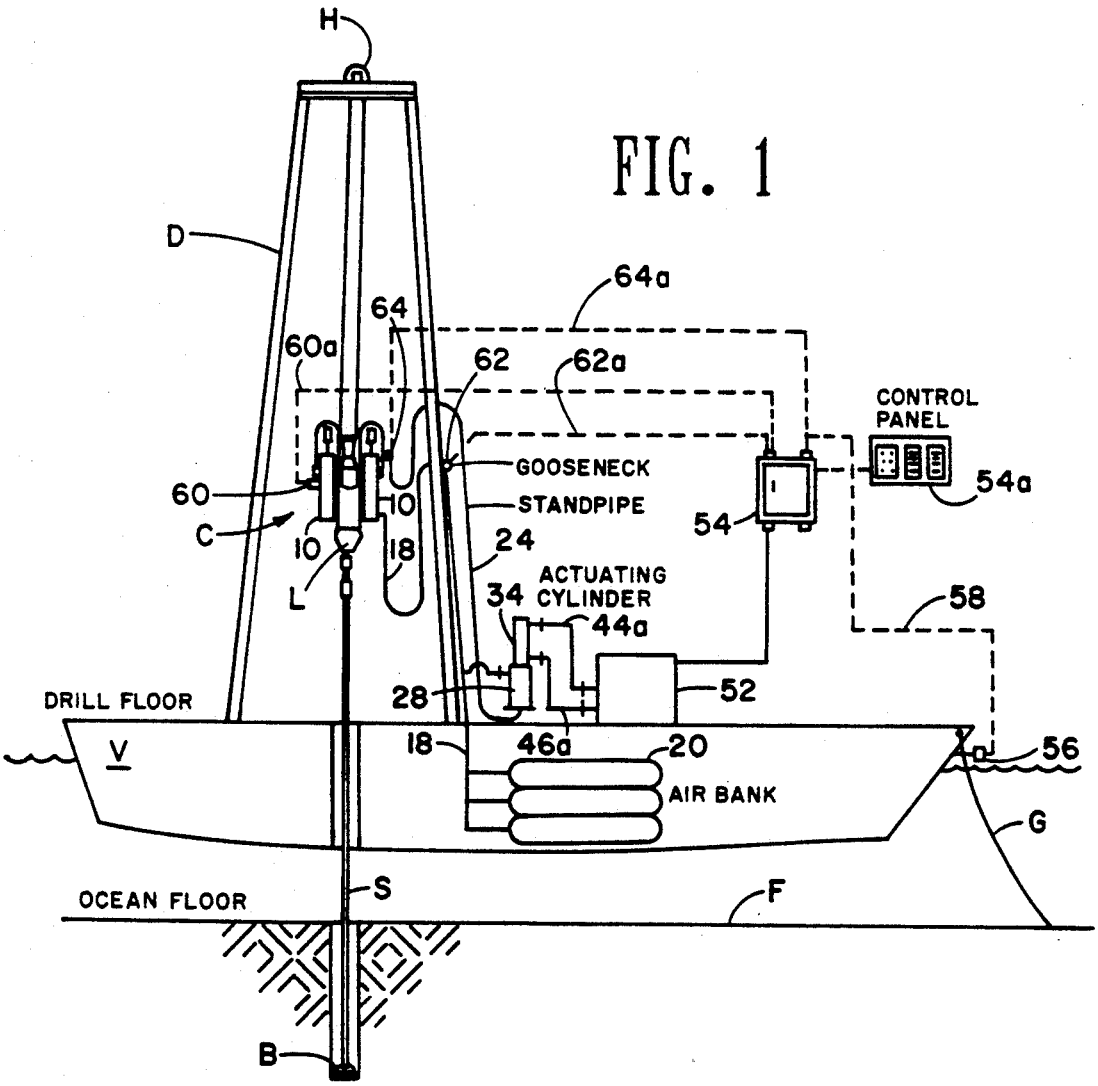
FIG. 1 is a diagrammatic view of a drilling rig mounted on a floating vessel for drilling a subaqueous borehole in the ocean floor, showing the semi-active heave compensating system of this invention attached to a drill string compensator of the "Rucker" type.
Figure 7:
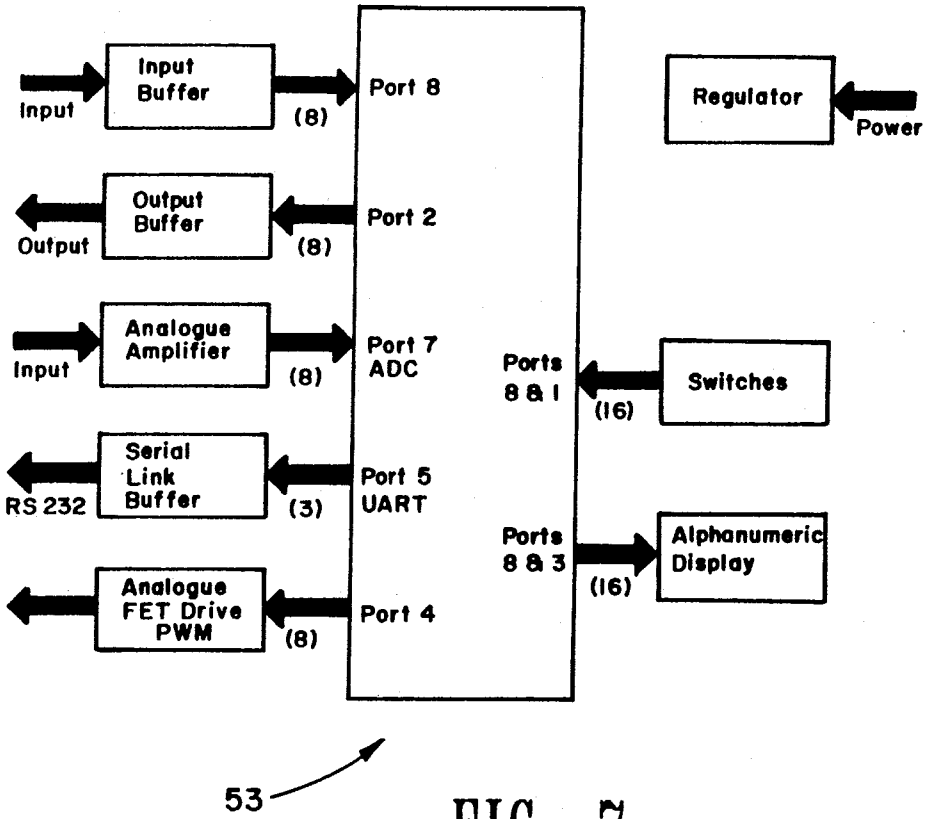
FIG. 7 shows diagrammatically the interfaces of the processor module used in the practice of this invention.

Turning now to FIG. 1, there is shown diagrammatically a drilling vessel V located above the drilling floor F showing a well W and bit B hung from the drill string S. The vessel V is secured in position by a guideline G anchored in the floor F and hooked to the vessel V usually through a cable tensioner compensating device, which also could be modified under the practice of this invention. For the purposes of discussing this invention, the specific embodiment of a drill string compensator C of the "Rucker" design is chosen as shown, for example, in U.S. Pat. No. 3,804,183, connected to drill string S and hung from crown block H of the derrick D. The compensator C, shown schematically on FIG. 2, which shows the parts of the prior art passive compensation system P, generally includes two cylinders 10 with pistons 12 and piston rods 14. In the "Rucker" type compensator C, the rods 14 are under compression (FIG. 1) against a cylinder of high pressure air 16 connected by conduits 18 with air bank 20. In the prior art passive system, the area above the piston 12 contained low pressure oil 22, which communicates through line 24 with low pressure oil tank 26 shown in phantom since it is removed when a passive Rucker system is modified to accommodate the active heave compensation system of this invention. In the present system, oil line 24 continues to the main cylinder of the accumulator 28, which also includes two chambers separated by an accumulator piston 30, to which is attached a piston rod 32, which extends through the top of the main cylinder and into the actuator cylinder 34, where it joins an actuator piston 36 and extends through the top **34*a* of the actuator cylinder 34. Of course, appropriate packing is used throughout, which is well-known to those of ordinary skill in the art. Accumulator 28 is divided by piston 30 into a hydraulic fluid area 38 and a high pressure air area 40. The high pressure air chamber 40 is connected to air bank 20 through line 42 and thence line 18. The oil chamber 38 is connected through line 24 to the oil chamber 22 of the compensator C. Normally the drill string compensator has a desired position for operation on a set point to which to return after compensation for a change in conditions for movement caused by the seas. In the drawing on FIG. 6 showing the accumulator, the oil line 24 is attached to the accumulator 28 through flange 24*a*, with the air line attached to accumulator 28 through flange and nipple 42*a*. The rod 32 is preferably large in order that the volumes of fluid within the accumulator 28 and the actuator 34 are kept small to increase the responsiveness to the controls. The actuator 34 is also separated into an upper chamber 44** and a lower chamber 46 by piston 36. Both chambers 44 and 46 are filled with a suitable hydraulic fluid connected through lines 44a and 46a to a swash pump 48, which has its volume and direction of output controlled by servovalve 50, FIGS. 3 and 5, which adjusts the angle of the swash plate within the swash pump 48. The power unit 52, preferably a 50 kw power unit in the described embodiment, includes the swash pump 48 and servo valve 50 and motor 48a for pumping hydraulic fluid from the swash pump 48 to the actuator 34 for operation of the piston 30 in accumulator 28. The power unit 52 is controlled by the compensator controls 54, which includes control panel 54a. Within control unit 54 is a microprocessor 53, which can be set up by the skilled engineer to operate within the parameters described (FIG. 7). One of ordinary skill in the art viewing this diagram of the microprocessor 53 could, giving consideration to the following discussion of the control system, could construct the program with a minimum of explanation.

In normal operation using a passive compensation system, when the vessel V heaved upwardly, the tendency was to lift the bit B off of the bottom of the well W thus increasing the pressure in the high pressure air chambers 16 of the compensator C by virtue of the drill strings creating a load L on the compensator C, urging the pistons downwardly. This would cause oil to be drawn from the tank 26 (FIG. 2.) through lines 24 into the oil chambers 22 forcing the pistons 12 downwardly against the air pressure, thus lowering the string S such that the bit B remains in the bottom of the well W and that the load on the bit B remains substantially the same as the vessel V settles as the wave subsides, restriction to oil flow through line 24 retards the return of piston 12 to the original position thus dumping the oscillation of the system. However, in the passive system, the great volume of air in the air bank 20, the friction losses in the lines and piston, as well as the sensing delays, frequently can cause a variance of 10% or more in the weight on the bit B. At a 400,000 pound load on a bit, and plus or minus 10% variance, the weight can vary as much as 80,000 pounds. Further, the passive system has no real frame of reference unless the bit B is resting upon the bottom on the well W and therefore, only is marginally available for the positioning of perforating equipment, packers or setting a blowout preventor on the bottom.

In the operation of the active drill string compensation system of this invention, when the drilling vessel V heaves or gives an upward lift from wave action, the guideline G is tensioned. The guideline sensor 56 senses this and communicates changes continuously through electrical line 58 to the control module 53 in control unit 54. Simultaneously with the heave of the vessel V, the drill string S puts more weight on the load L which causes the drill string compensator C to react by additional pressure from piston 12 on the high pressure air chambers 16. The movement of the piston 12 is detected by the DSC sensor 60, which senses a change in the position of the piston 12 of the drill string compensator (DSC) C. At the same time, the high pressure air sensor 62 connected to line 18 at a distance from the compensator C between the tanks 10 and the air bank 20, senses the increase in pressure from movement of the piston 12. The change in position of the compensator detected by the sensor 60 and the changes in pressure detected by the sensor 62 are communicated to the control unit 54 through lines 60a and 62a, respectively. The modular microprocessor shown diagrammatically as 53 residing within the hydraulic control unit 54 would compute the rate of change in the signals received from sensors 56, 60 and 62 and comparing with the information from the swash angle sensor 48a within pump 48, which is communicated to the microprocessor 53 which compares the values and adjusts the swash angle such that the output of pump 48 through lines 44a or 46a, as the case may be, will offset the changes and rate of heave in the vessel V, thus reducing the disturbance of the weight on bit B in well W. The output of pump 48 through lines 44a or 46a is proportional to the rate at which the vessel V is moving up or down, thus providing reduced response time and less load variation on the bit B. In the practice of the invention, the load variation is materially reduced to a maximum of about 7% or, where the 400,000 pound bit weight is involved, about 28,000 pounds. Considerably different from the passive system.

The pump 48 continues to pump through lines 44a or 46a into the actuating cylinder chambers 44 or 46, respectively, urging the piston 36 either up or down in response to the heave direction. Motion of the piston 36 moves rod 32 which in turn changes the position of piston 30 in the accumulator, which in turn, in the case of a heave upward would push oil out of the oil chamber 38 through line 24 to the DSC C. In the case of a Rucker DSC, it would be into a chamber in the annulus of the cylinders 10. At that point the pressure is sensed through the oil pressure sensor 64, which information is conveyed to control unit 54 through line 64a. The differential system pressure is indicator 63 on the control panel 541. While fluid is being pumped from pump 48, the pressure of the oil in the upper chamber 44 of the actuating cylinder 34 is measured through sensor 44b. Likewise the pressure of oil cylinder 46 is measured through sensor 46b, with the values being communicated to the microprocessor through lines 44c and 46c, respectively. In the operation of the pump, oil is fed to it through a header tank 48b through line 48c through boost pump 48d and pilot pump 48e to servo valve 50, which operates in response to signals from the microprocessor which varies the direction of flow of oil to the pump and from the pump thence to the header tank through line 48f, thus maintaining the level of oil, usually about 400 liters in an operation being described. The pump 48 is driven by motor 48g.

By virtue of the guideline sensor 56 on guideline G, a frame of reference with the ocean floor F is established, thus allowing the load compensation system of this invention to be successfully used in positioning a packer in the borehole of the wells, perforation equipment and to set a blowout preventor on the bottom while compensating for heave, even in relatively heavy seas. The ability to operate in more heavy seas stands to save millions of dollars in a single well operation by reducing the number of trips required in and out of the hole, often moving miles of drill string. Thus it is seen that tremendous savings result from installing this system. Of course, the active system of the invention does not have to be added to an existing system. It can be assembled and installed on an independent system.

Figure 4:
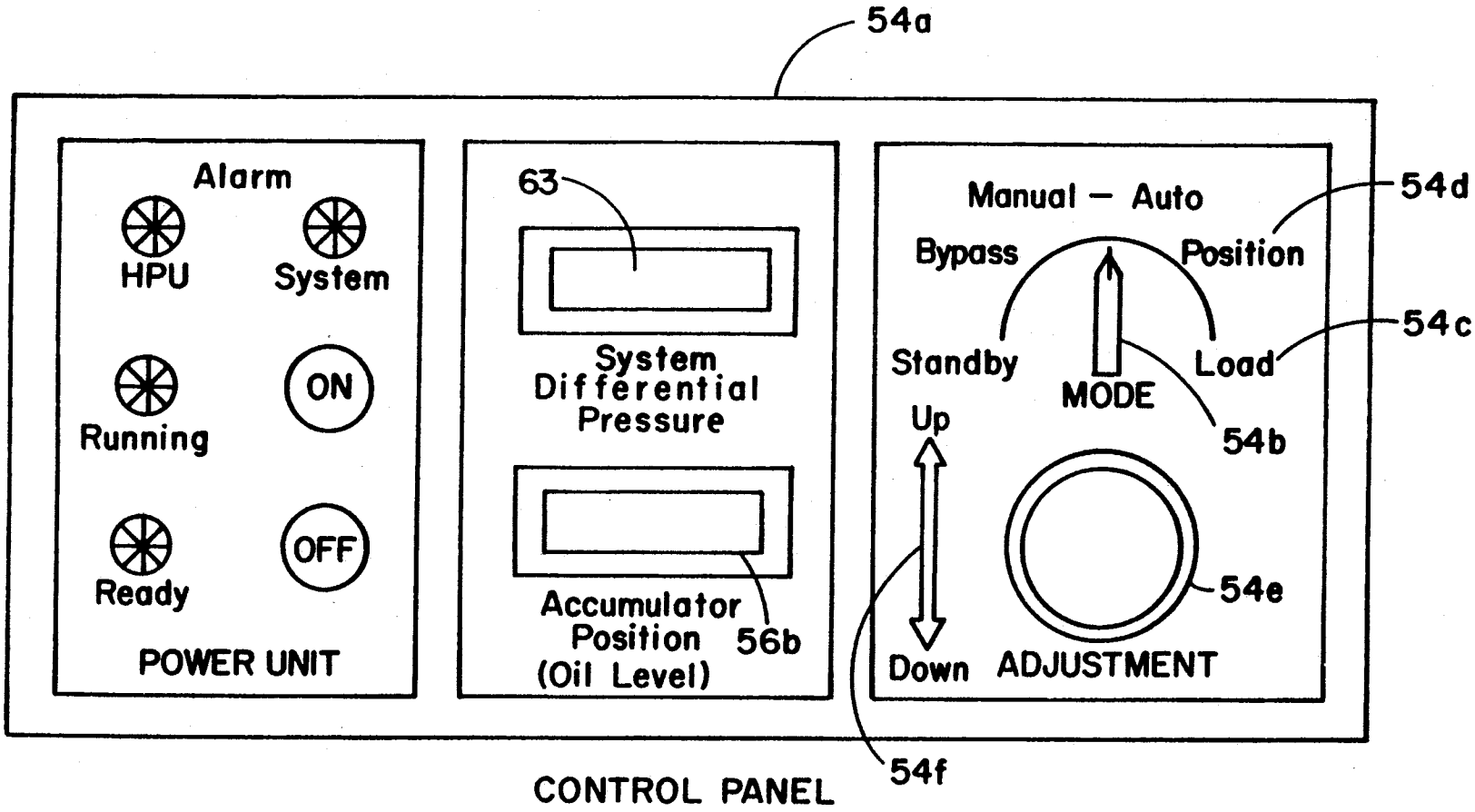
FIG. 4 shows the face of the control panel for operation of the system of this invention.

As is seen in FIG. 4., the control panel 54a of control unit 54 includes two operating positions selected by the mode the switch 54b. Automatic operation in the load position 54c was discussed above. The position mode 54d allows a position to be selected through the adjustment 54e, which reads out changes shown on the indicator 54f. Thus when a change is detected in the DSC sensor 60, the active compensator system takes effect to return the position of piston 12 to its location. Therefore, for a given number of joints of pipe, it returns it to the original desired, or selected, position.

In normal drilling mode, for best results the drill bit B works with a steady pressure against the bottom of the well W for maximum efficiency, neither being lifted off the bottom or excessively loaded. The load on bit B is only a small portion of the weight of the full drill string S, the remaining weight being carried by the DSC C. The constant pressure mode of the active system of this invention is used typically for conventional drilling and allows maximum penetration rate without manual intervention, other than occasionally lowering the compensator as drilling progresses in an automatic drilling mode. This feature widens the weather window for this type of operation and provides positive control of the compensator position. Although the maximum compensator stroke is typically from 18 to 25 feet while carrying a very heavy load, the object is to keep the load steady with respect to the floor F which requires the minimization of inertial effects in the system. By responding with the system to the rate of change caused by the ocean, the inertia effects are quickly offset. It is also desirable for successful operation of this system that the piston 30 of the accumulator 28 be monitored through position sensor 66, which continually conveys the accumulator position through line **66*a* to indicator 66*b* on the control panel 54*a*. The accumulator sensor 66 serves an additional purpose in that it provides a warning should the accumulator piston 30 near the end of the stroke in oil chamber 38 indicating that additional oil supply is needed for the accumulator 28**.

The position mode is typically used during operations when handling equipment such as the BOP, logging and fishing tools, setting packers and perforating. This position mode can also be used for "slim hole drilling" offshore, which involves using lighter, smaller and thus, less expensive, drilling equipment otherwise unusable when passive compensation is relied upon to maintain constant position in the drilling.

Figure 5:
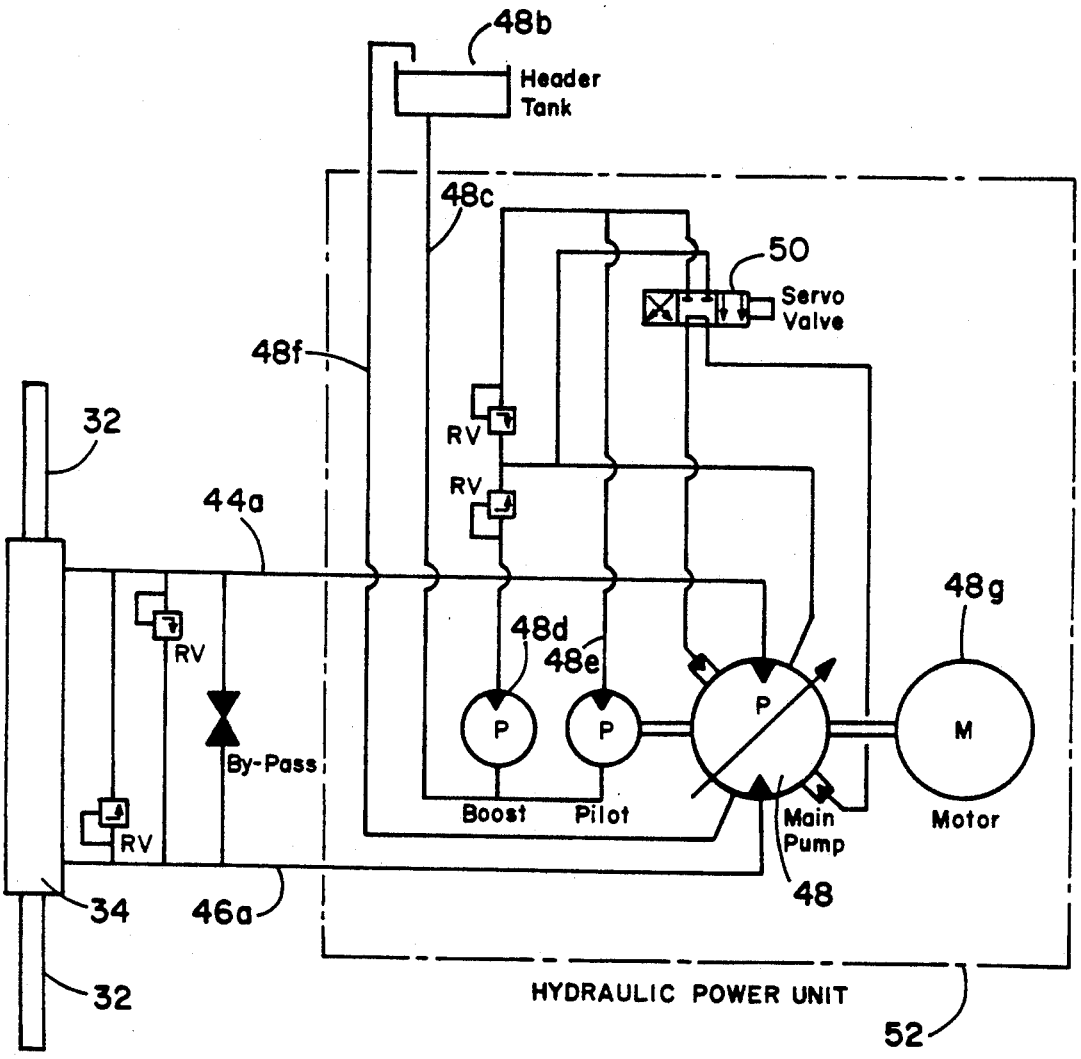
FIG. 5 is a schematic diagram showing the pump, pump fluid lines and a preferred connection scheme with the actuating cylinder of the accumulator.
Figure 6:
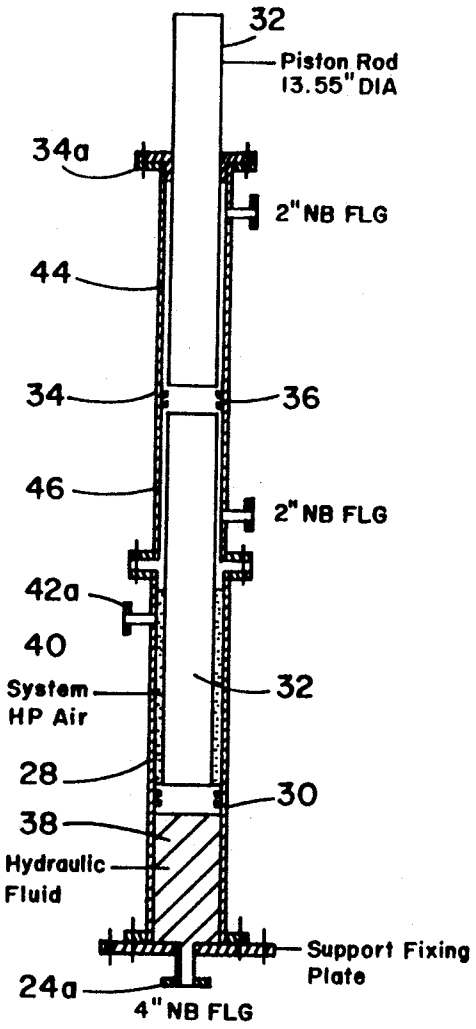
FIG. 6 is an elevation, in section, of the actuating accumulator of this invention.

The control strategy implemented by control unit 52 using a computer module 53, such as shown in FIGS. 5. and 7. is within the skill of the ordinary electronics engineer familiar with the parameters as sensed above and the desire to compensate for system friction and flow losses as discussed above. The module, once prepared, is preferably a single chip microprocessor designed to meet the implementation as required; i.e., whether it is a drill string compensator, a cable tensioner, a tension leg platform compensator system, or merely a crane operation with a wireline. Such computer control systems for each application will vary slightly, but within the skill of the program following the requirements as set forth above and the discussion which follows. In preferred embodiment, the computer module 53 in FIG. 7. provides for receiving inputs from sensors 56, 60, 62 and 64 while delivering an output to the servovalve 50 on the main pump 48. The signal for the servo valve 50 includes energizing the solenoid as necessary for adjusting the flow of fluid through the pump itself. The module of FIG. 7 will optionally, and preferably, provide for adjustment, either manual or automatically, as illustrated on FIG. 3., the gain **52*b*, the scale 52*c*, which is used to input a constant into the system to compensate for flow losses and friction losses in the given systems. It could also be used to adjust the limits of the guideline tensioning system through adjustment 52*d* and various other parameters which would be specific to a particular operation. The processor module 53 should also communicate directly to operations personnel preferably to a personal computer through an RS232 serial link port in order to provide input for the various parameters in the system as they may be discovered to vary. Of course, as shown on the control panel 54*a* in FIG. 4**., an alarm system must be provided for in the module to warn in case the limits of stroke of the device being operated or any of the parts from which readings are taken or whether oil is being depleted in the accumulator.

Those familiar with microprocessors would very easily prepare the foregoing system. The module 53 can be controlled and programmed remotely using the RS232 serial link. In the preferred embodiment of this invention, the power supply is driven by 50 hz, 240 volt AC power. The drive signal to the servo would be from 0 to 100 milliamps and 12 volts. The system of the embodiment this invention described above would have a heave compensation performance based on a rig condition of about 12 feet heave in a 12-second period, requiring a maximum variation of 10 inches in a 12 foot heave. This amounts to a damping of the system of 93%, with a position accuracy of plus or minus 3.5%. Of course, in other systems, the accuracy may vary lesser or greater and the performance of the system of this invention would handle heave conditions of up to heaves of about 20 feet with a period of from between 8 seconds or greater. The optimum performance would occur between about 10 feet and 16 feet with a period of from about 8 to 16 seconds.

The actuating accumulator consists of two cylinders 28 and 34 assembled together by screwed and bolted flanges with an integral through piston rod 32 as shown in FIG. 6. All main connections provided on the actuating accumulator are preferably flanged.

The main accumulation cylinder 28 is connected via hoses to the compensator C through an annulus chamber for receiving and disbursing fluid. The double acting cylinder has a 15 foot diameter bore and is honed and chromeplated. Pressure is applied via a 13.5 inch diameter piston rod with 13 foot stroke and piston; elastomer seals are built into the piston. Elastomer seals and wiper ring are built into the neck of the cylinder, as usual. The cylinder is designed for about 2400 psi working pressure and for use with "Houghtosafe"273 while many well-known hydraulic fluids are suitable for use. Additional cleanliness protection of the fluids is provided through use of a breather unit. System pressure is used to generate a steady bias pressure 63 in the annulus area.

The actuating cylinder 34 is operated from the hydraulic power unit 54. In the preferred embodiment described above, the cylinder has an 14.5 inch diameter bore and is honed and chromeplated. The 13.5-inch diameter piston rod is double ended to ensure balanced flow with an overall stroke of 13 feet. Elastomer seals are built into the piston and flanged head of the cylinder. The cylinder is designed for 3500 psi working pressure and for use with Houghtosafe 273 hydraulic fluid.

The hydraulic power unit 52 includes the pump 48, which in the instance described above, is preferably Model P14P transmission pump (Dennison—Haggiands, Chicago, Ill.) with an Abex servo valve and stroke feedback pump fitted with boost and servofilters. The pump 48 would operate off a 50 kw electric motor **48*g* at about 1800 rpm. As stated previously, the header tank 48*b*** is preferably a 400 liter tank with site glass filters and the like. The size, of course, would vary according to need. In constructing the apparatus of this invention, it is preferably that stainless steel material be used in order to provide resistance to the environment in which it is being used and also to minimize the necessity of maintenance, even though stainless steel itself is not corrosion-proof.

Figure 2:
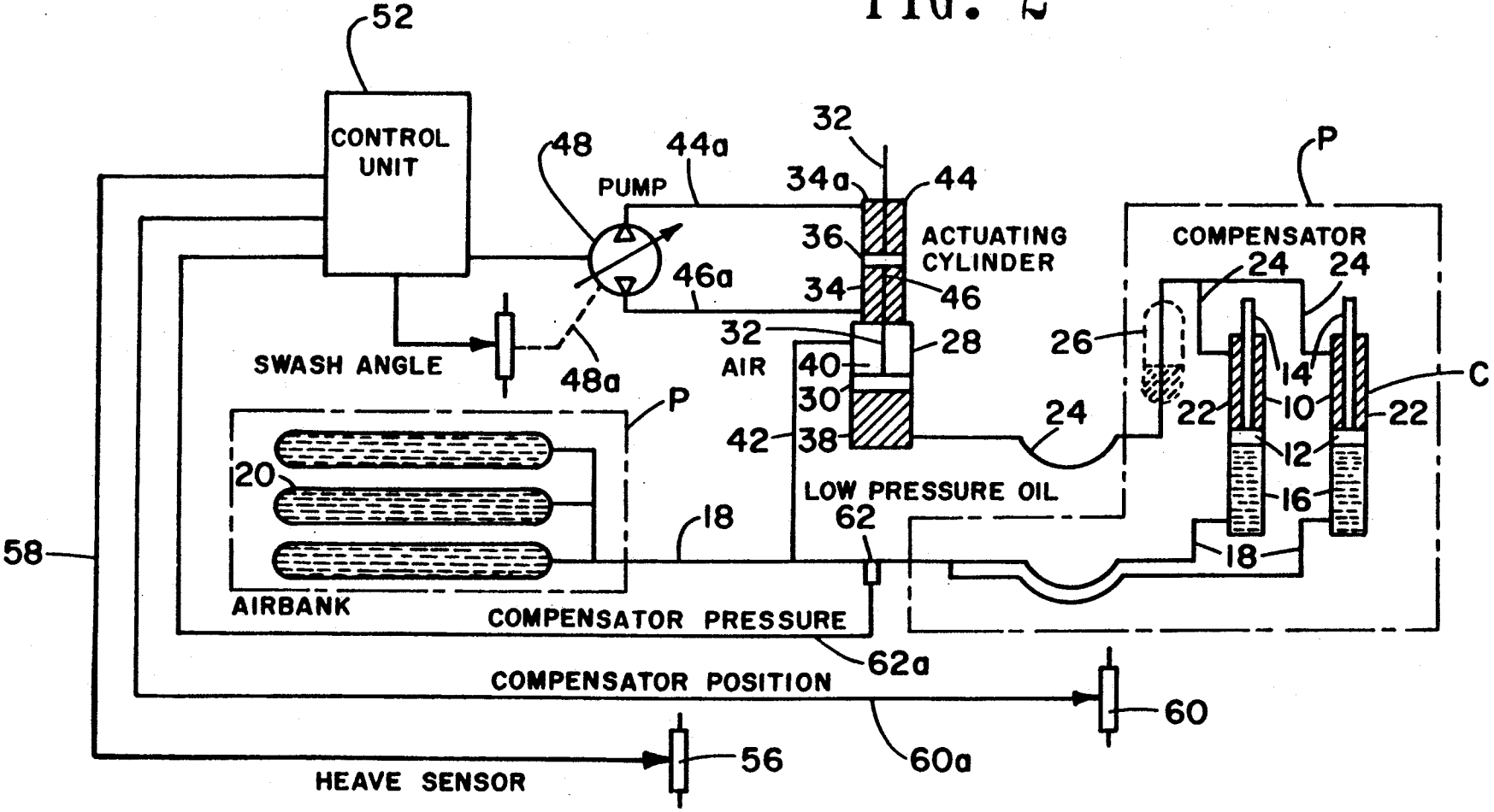
FIG. 2 is a diagram showing the interrelationship and connections of a standard passive drill string compensator system with the compensator system of this invention included.
Figure 3:
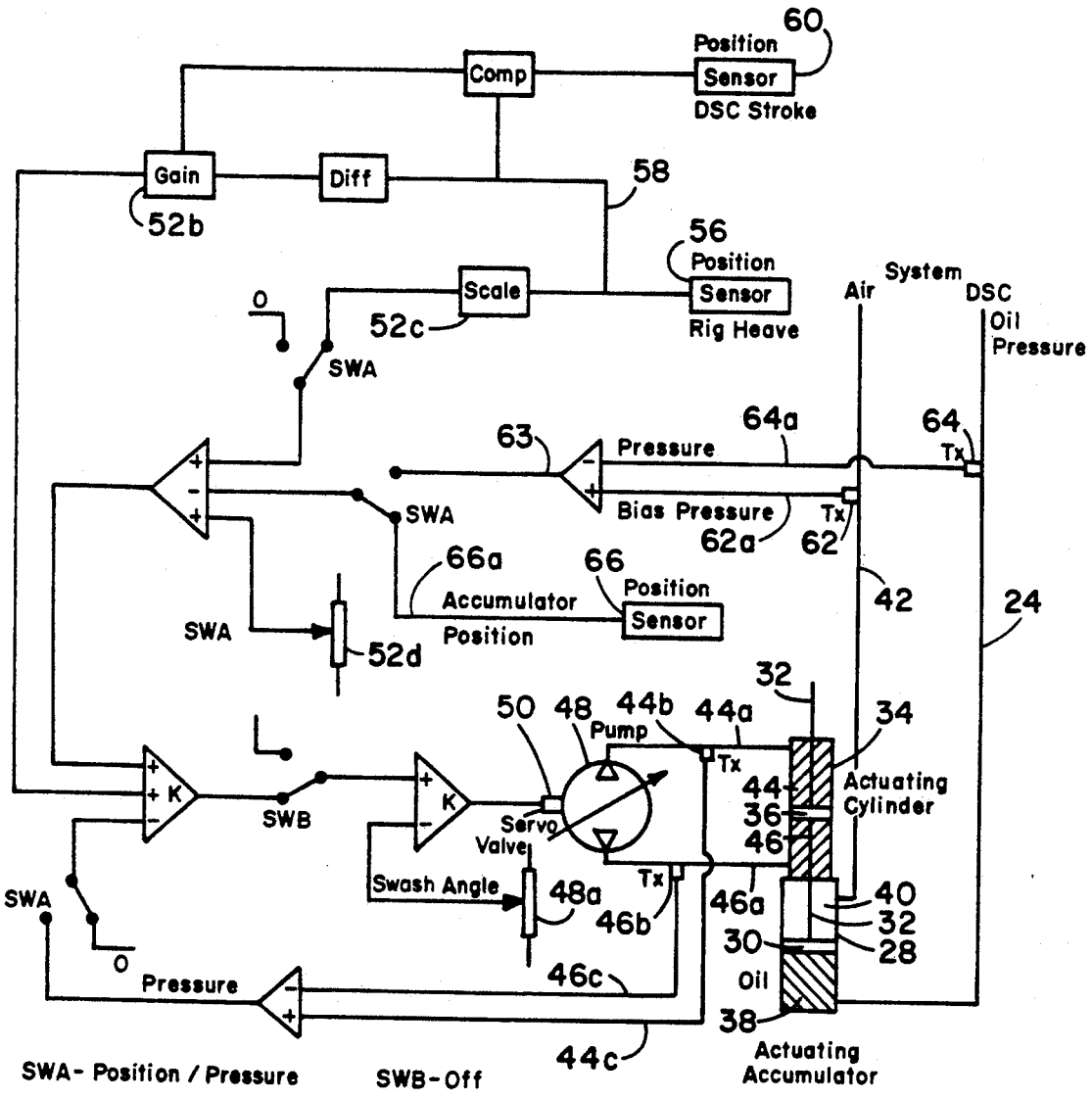
FIG. 3 is an electrical circuit diagram showing the control configuration of the compensation system of this invention as attached to the pump and accumulator.

The semiactive system shown on FIG. 2 would attach to existing passive systems P (also FIG. 2) in the functional positions shown. The programming of microprocessor 53 to operate the system would follow with determination of system-specific friction loss constants which would vary with length of lines or conduits, size and quality of equipment and the like.

Having described the operation and components of the semi-active heave compensating system of this invention as set forth above, one of ordinary skill in the art, using the description and knowledge of hydraulics and electronics common to this industry, could make such modifications as necessary to vary the use of the system within the heave compensating devices ordinarily used on marine vessels, particularly offshore drilling rigs; to-wit: drill string compensators, cable tensioners, tension leg platforms, wireline cranes and the like. Accordingly, in view of such numerous modifications which remain within the scope of the claims which follow.

We claim:

1. A system for compensating for the heave of waves on a marine vessel comprising, a fluid responsive compensator attached to the vessel including a load carrying means, a chamber for receiving and discharging fluid and a piston moving within said chamber in response to changes in fluid pressure to reposition the load carrying means relative to a set point in the compensation chamber, an accumulator chamber containing a fluid, in fluid communication with the compensator including a piston separating the accumulator chamber into two fluid reservoirs and having a rod attached to, and extending from, said piston;

an actuator cylinder having an actuator piston dividing the cylinder into a first and second chamber and rod connected on one end to the piston and on the other end to the piston rod of the accumulator such that the piston of the accumulator moves in response to movement of the actuator piston moving in response to changes of fluid pressure in the actuator chambers;

a variable pump in fluid communication with the two chambers of the actuator cylinder with the output of the pump being determined in response to a controller;

a means for sensing changes of conditions within the compensator from the set point and communicating the changes to the controller, which compares such changes to determine a rate of such change;

a means for sensing a wave heave in the vessel and communication of information sensed to the controller; and a means in the controller for comparing the information from such sensing means with the pump output and adjusting the output to return the conditions in the compensator to the set point.

2. The system of claim 1 where the fluid responsive compensator is a drill string compensator.

3. The system of claim 2 where the drill string compensator includes a pair of operation cylinders in fluid; the chamber for receiving and discharging fluid is in an annulus of each operating cylinder.

4. The system of claim 1 wherein the fluid responsive compensator is a cable tensioner.

5. The system of claim 1, wherein the compensator sensing means includes a sensor to detect values for each of changes in high pressure air pressure, position of piston in the drill string compensator and changes in the drill string compensator fluid pressure.

6. The system of claim 5, wherein the system operates responsively to maintain substantially constant load on the load carrying means.

7. The system of claim 5, wherein the system operates responsively to maintain a substantially constant load position.

* * * * *